United States Patent [19]

Poel

[11] 3,962,785

[45] June 15, 1976

[54] ELECTRIC TRIMMER

[75] Inventor: Hendrik Poel, Drachten, Netherlands

[73] Assignee: U.S. Philips Corporation, New York, N.Y.

[22] Filed: Mar. 25, 1975

[21] Appl. No.: 561,874

[30] Foreign Application Priority Data

Apr. 8, 1974 Netherlands ..... 7404738

[52] U.S. Cl. ..... 30/90; 30/34.1; 30/223

[51] Int. Cl.[2] ..... B26B 19/20; B26B 19/10

[58] Field of Search ..... 30/43.91, 43.92, 210, 30/221–224, 346.51

[56] References Cited

UNITED STATES PATENTS

| | | | |
|---|---|---|---|
| 2,827,695 | 3/1958 | Vitale | 30/43.92 X |
| 3,842,498 | 10/1974 | Mizobata | 30/43.92 |

*Primary Examiner*—Al Lawrence Smith
*Assistant Examiner*—Gary L. Smith
*Attorney, Agent, or Firm*—Frank R. Trifari; J. David Dainow

[57] ABSTRACT

An electric hair trimmer for use as a home appliance having cutters covered by a flap which in the closed condition resiliently presses against a movable trimming cutter, and in the open condition allows removal of the cutters for cleaning.

12 Claims, 7 Drawing Figures

ELECTRIC TRIMMER

BACKGROUND OF THE INVENTION

The invention relates to an electric trimmer having a housing whose longitudinal dimension is substantially greater than its transverse dimension, an electric driven motor which is accommodated in the housing, and a trimming cutter set which comprises a stationary trimming cutter and a cooperating trimming cutter which is reciprocatable by the motor. The cutters are each provided with a row of teeth and are together disposed near one end of the housing, in such a manner that the rows of teeth project from the housing; resilient means resiliently press the two trimming cutters against each other.

Electric trimmers may be distinguished between trimmers which are destined for professionals and trimmers which are destined to be used by amateurs at home. Trimmers of the first category should comply with stringent requirements as regards reliability and lifetime. This type of apparatus is therefore of very strong construction, the cutters of the trimming cutter set being very heavy and rugged and projecting completely or almost completely from the apparatus, so that they can be cleaned continually and easily. Trimmers of the last-mentioned category, however, are home appliances and must therefore be manufactured at the lowest possible cost price. When selecting the materials and the method of manufacturing the trimming cutter set, allowance is to be made for the fact that in most families a trimmer will be used with a comparatively low frequency so that even in the case of a relatively high wear, the lifetime of the trimmer will be appreciable. For this type of appliance the trimming cutters are therefore made of sheet steel, the material being hardened after the teeth have been formed and the cutters have been bent to shape, and being face-ground at the location of the rows of teeth and at a location opposite thereto. This type of trimming cutters is not mounted entirely outside the trimmer housing. For the most part they are mounted inside the housing and the stationary trimming cutter is connected to fixed parts thereof. Only a small part of the trimming cutters, near the rows of teeth, projects from the housing. It is evident that this presents certain problems with respect to the cleaning of the cutters and the surrounding part of the trimmer.

An electric trimmer of the present type is known from German Patent Application 2,241,284, which has been laid open for public inspection. To aid in cleaning, this known appliance is provided with a detachable section of the housing which can be removed without the use of tools and to which the trimming cutter set is secured. A plastic guide member is secured to the movable trimming cutter with the aid of screws, this guide member being provided with two cams which extend through the movable cutter into two guide slots of the stationary trimming cutter. In the detached condition of the detachable housing section, the stationary trimming cutter faces the open side and is rigidly connected to the housing section with the aid of two self-tapping screws. Thus, the stationary trimming cutter covers the movable trimming cutter. The last-mentioned cutter is pressed against the underside of the stationary trimming cutter with the aid of two conical, helically wound springs which are disposed between the plastic guide member and the housing section.

This known trimmer can be cleaned to a limited extent only. Hair clippings may readily collect between the two trimming cutters and also between the movable trimming cutter and the housing section. These normally inaccessible spaces become accessible only when the two self-tapping screws are removed, after which the various parts can be detached and cleaned completely. The two self-tapping screws are fitted in hollow protrusions which are integral with the housing sections. When the trimming cutter set is fitted for the first time, the self-tapping screws cut thread into the plastics projections. As is known, turning self-tapping screws several times into and out of a plastic does not promote a firm connection between the parts to be connected, because eventually the thread will be damaged beyond repair, so that the firm connection is impaired.

SUMMARY OF THE INVENTION

It is an object of the invention to provide a trimmer of the type mentioned in the preamble, which mitigates the mentioned drawbacks of the known construction and which is characterized in that the part of the trimming cutter set which is disposed inside the housing is covered by a flap which is connected to the housing so as to be hingeable about a center line parallel to the rows of teeth of the trimming cutters. Resilient means cooperate with the flap, and in the closed condition of the flap press against the flap at one side and against the drivable trimming cutter at the other side; the flap is locked in the closed condition with the aid of spring-loaded locking means. The distance over which the resilient means are depressed to obtain the resilient loading of the trimming cutters is smaller than the distance over which the part which pressed against the flap is moved when the flap is opened.

In one preferred embodiment the movable cutter, in a known manner is slidable relative to the stationary cutter with the aid of cams and slots which cooperate with each other and when the flap is open is readily removable. This last-mentioned step can be easily realized in conjunction with the previously mentioned steps according to the invention, because the movable cutter faces the side of the flap and is consequently not covered by the stationary trimming cutter. Therefore, the trimmer according to the invention can be cleaned very easily, the trimming cutters each being readily and effectively accessible. A further embodiment of the invention is characterized in that the resilient means consist of at least one helically wound spring with elongated straight ends which is made of steel wire, which is disposed around a spindle which is rigidly connected to the housing parallel to the rows of teeth. One of these elongated ends resiliently loads the drivable trimming cutter in the closed condition of the flap and the other end the flap; and that in the open condition of the flap the angle between the two prolonged ends is smaller than the angle through which the flap is hingeable.

Still another embodiment is characterized in that a drive member for the drivable trimming cutter is reciprocatable and hingeable on said spindle; the drive member and the movable trimming cutter are coupled to each other in the closed condition of the flap by means of a drive cam on one of these components which engages with a corresponding opening in the other component; the resilient means are disposed between the flap and the drive member with said elongated ends in the closed condition bearing on the flap and the drive member, with the drive member in the closed position of the flap pressing on the movable trimming cutter the drive member, at least in the closed position, is coupled to the drive motor.

In another embodiment the flap and the drive member are rotatable relative to each other through an angle which is smaller than the angle through which the flap is hingeable relative to its closed position, and the flap and the drive member are provided with corresponding stop means which prevent a further mutual rotation.

In yet another embodiment of the invention the flap and the drive member are loaded by the resilient means disposed between them in opposite directions also at the maximum angle of rotation between them.

The invention will now be described in more detail with reference to the drawing:

DETAILED DESCRIPTION OF THE PREFERRED EMBODIMENTS

Figure 1:
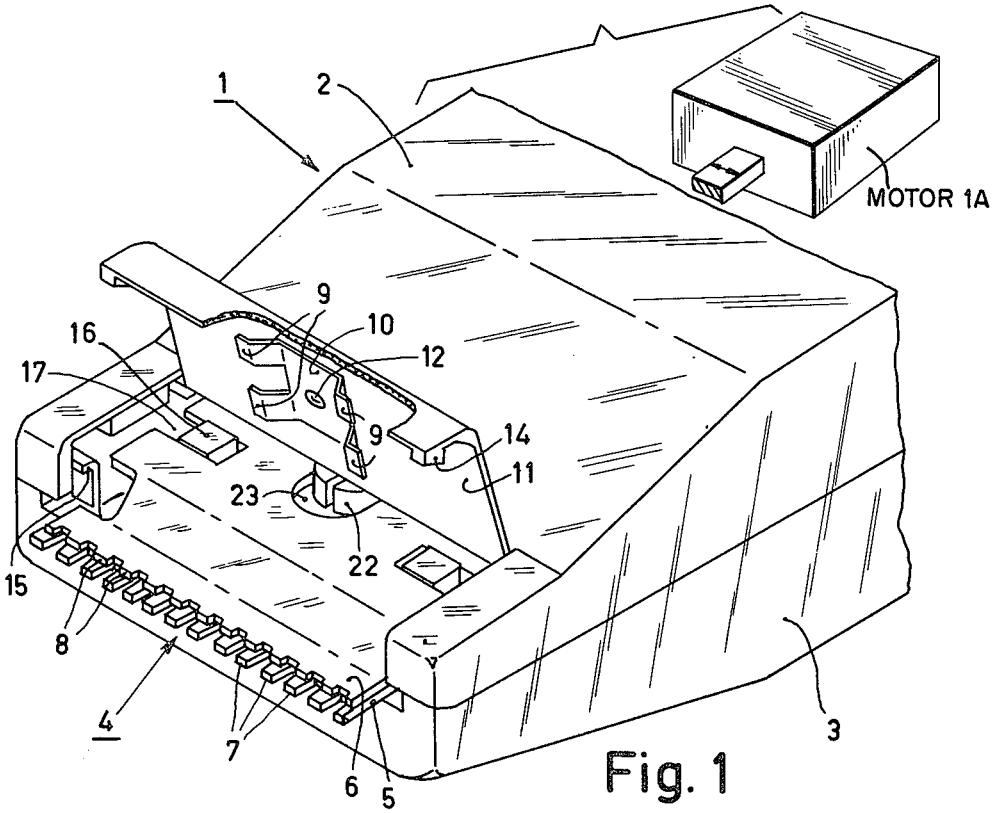
FIG. 1 is a partial prospective view of a first embodiment, showing the front part of a trimmer.

The electric trimmer of FIG. 1 comprises a housing 1 which consists of two halves 2 and 3 and which has a longitudinal dimension which is substantially greater than the transverse dimension. The housing accommodates an electric drive motor, which is represented schematically by element 1A. The trimmer comprises a trimming cutter set 4 which consists of a stationary cutter 5 and cooperating therewith a trimming or drivable cutter 6 which is reciprocatable by the motor. The trimming cutters are each provided with a row of teeth 7 and 8 respectively and are together disposed near an end of the housing, in such a way that the rows of teeth or cutting edges project from the housing. The resilient means, which when deflected from its relaxed state to its deflected state resiliently presses the two trimming cutters 5 and 6 against each other, is constituted by four leaf springs 9 which all form part of a single component 10 which is made of spring steel.

The part of the trimming cutter set 4 which is located inside the housing 1 is covered by a flap 11 which is connected to the housing section 2 so as to be hingeable about a centre line parallel to the rows of teeth 7 and 8 of the trimming cutters 5 and 6. This flap is made of a plastic with a pin 12 for attachment of component 10 to the flap 11, the pin 12 deformed by means of a heat treatment. In the closed condition of the flap the springs 9 press at one side against the flap itself and at the other side against the movable trimming cutter 6. In this condition the flap is locked with the aid of locking means which are loaded by springs 13, see FIG. 3; the locking means consist of the locking tabs 14 and the locking edges 15 of the housing section 3, which cooperate with said tabs in the closed condition of the flap.

The distance over which the leaf springs are depressed to obtain the resilient loading of the trimming cutters 5 and 6 is smaller than the distance over which the component 10 which presses against the flap is moved when the flap 11 is opened. This last-mentioned step ensures that in the open position of the flap the cutter set 4 is actually accessible and is no longer loaded by the springs.

Figure 3:
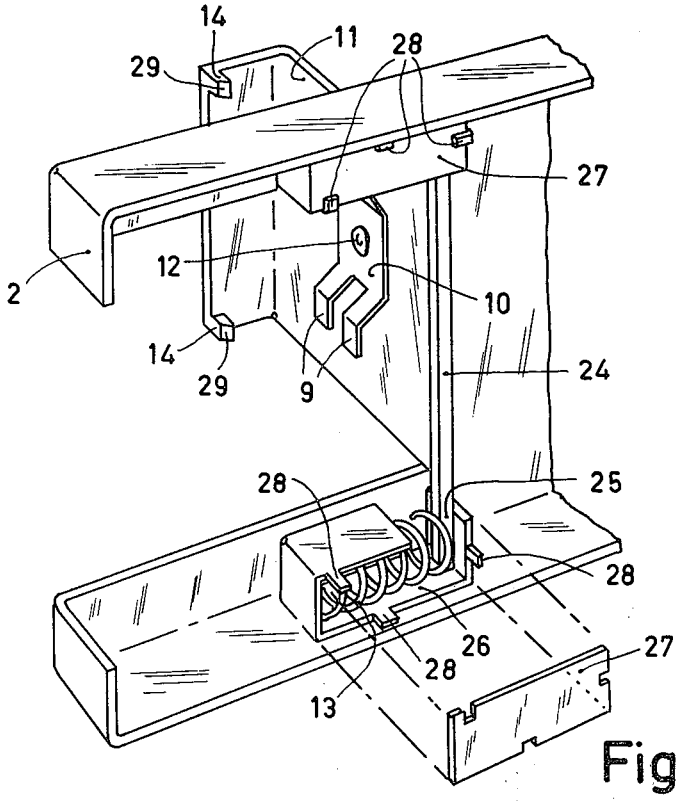
FIG. 3 is an exploded view in perspective of the upper part of the trimmer of FIG. 1.
Figure 2:
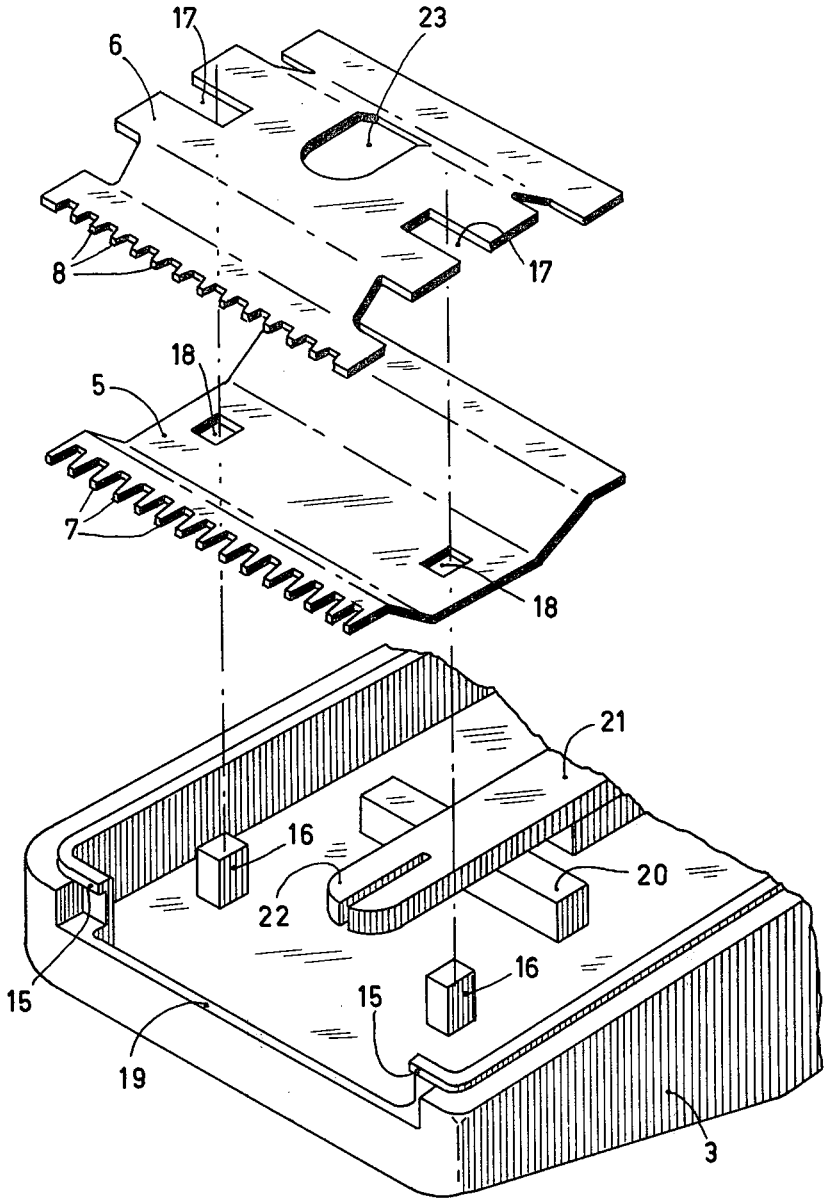
FIG. 2 is an exploded view in perspective of the lower part of the trimmer shown in FIG. 1.

The movable cutter 6 is slidable relative to the stationary cutter 5, in a manner known per se, with the aid of cooperating cams 16 and slots 17 and is readily removable when flap 11 is open. The stationary cutter 5 is centered relative to the cams 16 with the aid of recesses 18, see FIG. 2. At the front side said cutter engages with an edge 19 of the housing section 3, and at the rear with a rim 20 which is formed in the housing section 3. The movable cutter can be reciprocated via a drive lever 21 which is provided with a slotted and rounded end 22 which extends in the recess 23 of the movable cutter 8. The flap 11, see FIG. 3, is provided with an integral hinge pin 24 at its hinged end. With its ends 25 said hinge pin engages chambers 26 at either side of the flap, which chambers accommodate the springs 13 and which are closed with the aid covers 27, which are retained by projections 28 which have been deformed by heat. The hingepin 24 has a substantially square cross-section, so that in the position of FIG. 3 the flap is in a stable condition. For closing the flap it suffices to press on the flap, after which when the flap is substantially closed the rising edges 29 of the cams 14 slide over the edges 15 until the cam 14 has come beyond the edge 15, after which the two springs 13 pull the flap slightly backwards and it is resiliently locked. When the flap 11 is open the two trimming cutters of the cutter set 4 may simply be taken out by hand so that both the space between the two cutters and the surrounding space in the trimmer can easily be cleaned.

Figure 4:
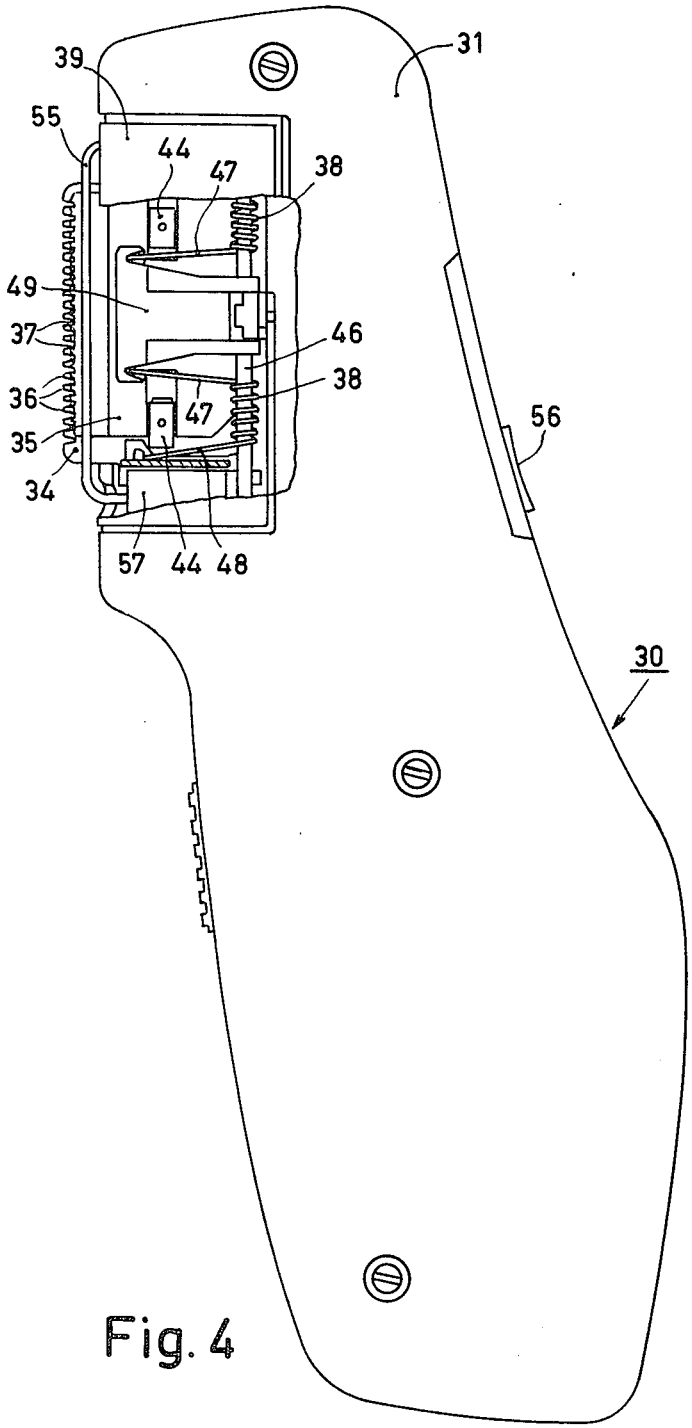
FIG. 4 is a top plan view of a part of a second embodiment of the invention.
Figure 5:
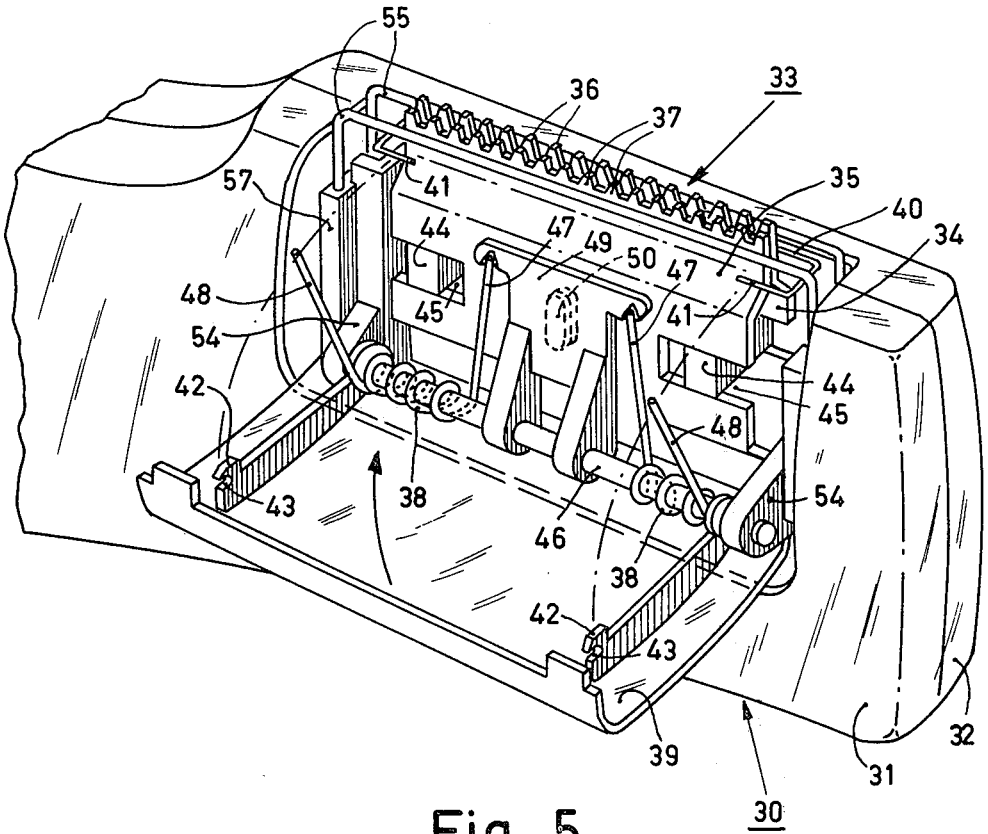
FIG. 5 is a perspective view of the front part of the trimmer of FIG. 4 with open flap.

The trimmer of FIGS. 4 and 5 comprises a housing 30 which also has a longitudinal dimension which is substantially greater than its transverse dimension and which consists of two housing sections 31 and 32. In these FIGS. the electric drive motor is not shown but is operable as described earlier. The trimming cutter set is designated by the reference numeral 33 and comprises a stationary cutter 34 and a movable cutter 35. The cutters are provided with teeth 36 and 37 which project from the housing near the end of the housing 30. The trimming cutters 34 and 35 are resiliently pressed against each other by two springs 38.

The part of the trimming cutter set 33 which is located inside the housing 30 is covered by a flap 39, which is hinged to the housing and which is rotatable about a centre line which is parallel to the rows of teeth 36 and 37. The springs 38 are connected to the flap 39 and in the closed condition of the flap press at one side against the movable trimming cutter 35 and at the other side against the flap. For clarity FIG. 5 shows a situation in which the flap 39 is open and the springs 38 are no longer connected to the flap. Therefore, in FIG. 5, the flap 39 is not operative to engage the springs 38 until it is closed. For locking the flap 39 a resilient bracket 40 is disposed near the rows of teeth 36 and 37, whose ends 41 can cooperate with the cap 39. For this purpose the flap is provided with tabs 42 and locking slots 43. The springs 38, in order to resiliently load the trimming cutters 34 and 35, are depressed over a distance which is smaller than the distance over which the part which presses against the flap 39 is moved when the flap is opened.

The housing section 32 is provided with integral guide cams 44 which cooperation with slots 45 of the movable cutter. Cooperation with the stationary trimming cutter 34 of the trimmer of FIGS. 4 and 5 takes place in the same way as previously described for the embodiment of FIGS. 1 through 3.

The springs 38 consist of helically wound steel-wire springs with elongated straight ends 47 and 48 which are disposed around a spindle 46 which is rigidly connected to the housing and which extends parallel to the teeth 36 and 37. In the closed condition of the flap 39 the two ends 47 press on the drivable trimming cutter 35 and the ends 48 against the flap 39. The ends 47 do not directly press on the trimming cutter 35 but on a drive member 49 which is reciprocatable on the spindle 46 and which is also hingeable about it. The drive member has a drive cam or projection 50 at its side which faces the drivable trimming cutter 35, which projection cooperates with a corresponding recess 51, for this see in particular FIGS. 6 and 7. The springs 38 are disposed between the flap 39 and the drive member 49, and the ends 47 and 48 bear on the drive member and on the flap respectively in the closed position. In the closed position of the flap the drive member 49 in its turn presses on the movable trimming cutter 35. Furthermore, the drive member 49 is in its drive position when flap 39 is in its closed position, the drive member being coupled to the drive motor 46A which is accommodated in the trimmer housing 30.

Figure 6:
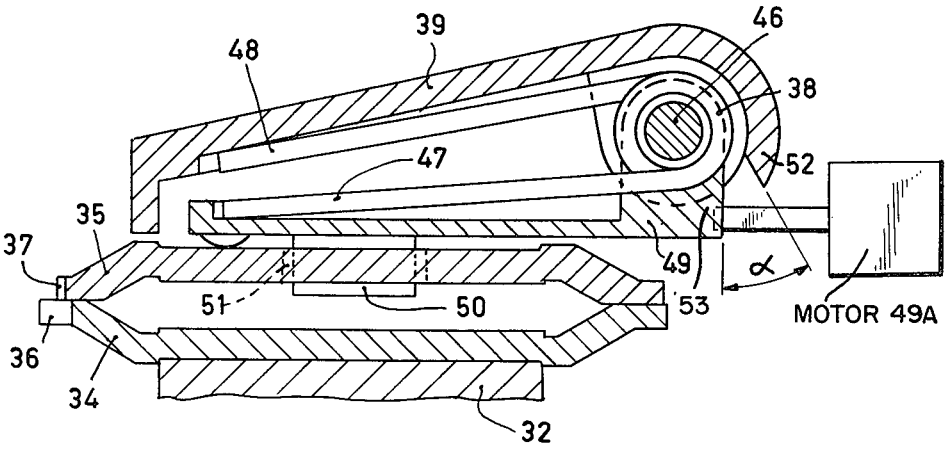
FIG. 6 is a schematic cross-section of the flap and the trimming cutter set of the trimmer according to FIGS. 4 and 5.
Figure 7:
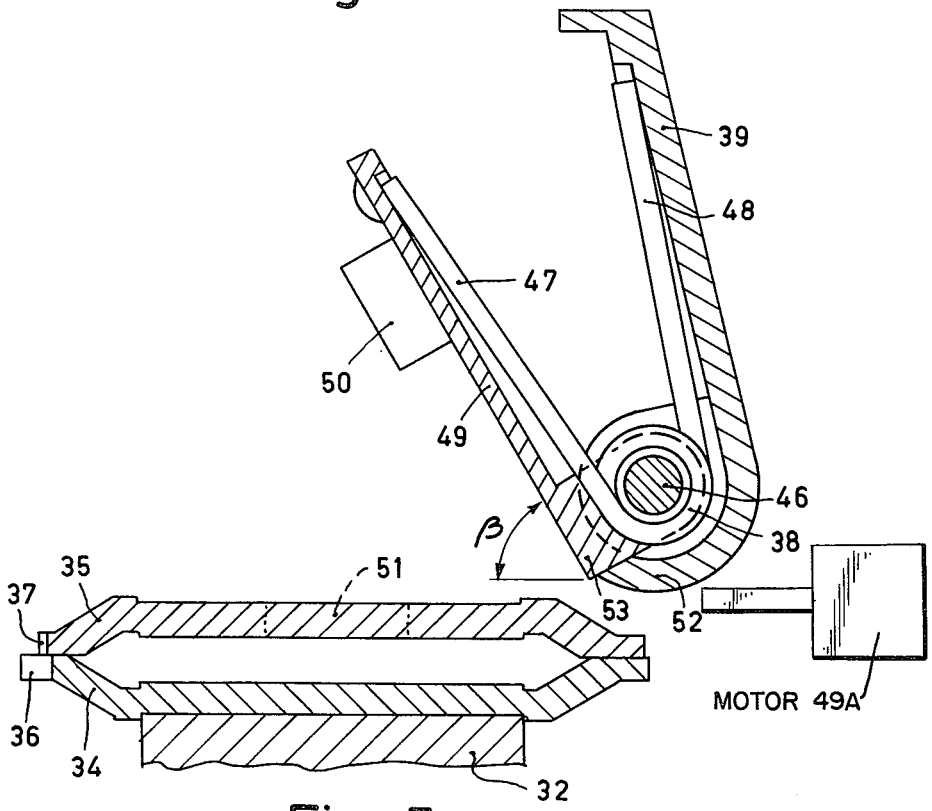
FIG. 7 is a schematic cross-section similar to FIG. 6, in the situation in which the flap is open.

The flap 39 and the drive member 49 are rotatable relative to each other through an angle $\alpha$ which is smaller than the angle $\beta$ through which the flap can be hinged relative to its closed position; to establish this relationship the flap and the drive member are provided with corresponding stop means 52 and 53 which prevent a further mutual rotation. FIGS. 5, 6 and 7 show an embodiment of the invention in which the flap 39, in a similar way as the drive member 49 is journalled on the spindle 46. The spindle is at either end disposed in supports 54 which are connected to the housing 30. However, for technical reasons it may be advantageous not to mount the flap 39 on the spindle 46, but to render it independently hingeable relative to the housing section 31 with the aid of laterally disposed bearing journals.

In the situation shown in FIG. 7 in which the flap 39 is in the extreme outwardly directed position, the flap 39 and the drive member 49 are loaded in opposite direction by the ends 47 and 48 of the springs 38, so that the stops 52 and 53 are resiliently pressed against each other, and the drive member is in its neutral position, disengaged from the motor and from the drivable cutter.

In fact said situation should have been shown in FIG. 5, but as explained previously, for the sake of clarity this situation was not shown in FIG. 5. In the fully hinged-out condition of the flap 39 the two trimming cutters 34 and 35 can simply be taken out of the appliance. They may also be shaken out of the appliance by holding the appliance upside down above the open palm of the hand. Thus, the appliance of FIGS. 4 and 5 can also be cleaned very simply. The two brackets 55 which are located at either side of the trimming cutter set 33 constitute no impedance for this. These brackets are slidable parallel to the rows of teeth 36 and 37 with the aid of the slide button 56 which is disposed at the opposite side of the housing, which button is connected to the slide member 57, and form an adjustable guard for the trimming cutter set 33. The flap 39 does not open until the brackets 55 are slid out as far as possible. When said extreme position is reached, in which the slide button 56 is moved up as far as possible from the position shown in FIG. 4, the slide member 57 presses against the two ends 41 of the resilient bracket 40, so that said ends are pressed out of the locking slots 43 and the flap 39 pops open under the influence of the pressure exerted on it by the ends 48 of the spring 38. The flap now rotates through an angle $\alpha$, the stops 52 and 53 then coming into contact with each other, after which the flap can be further opened by hand. As the brackets 55 are in the fully slid-out position they present no further impedance for removal or dropping out of the two trimming cutters 34 and 35. The slide member 57 is resiliently pressed back by the ends 41, so that after the two trimming cutters have been cleaned, and as the case may be lubricated, and the space in the housing has also been cleaned, the flap 39 may be closed again by pressing it home manually, after which first of all the drive member 49 comes into contact with the drivable trimming cutter 35, subsequently the flap 39 can further be closed by hand against the pressure of the spring 38 through and angle $\alpha$, and finally the tabs 42 slightly bend the ends 41 until they snap into the locking slots 39 by their own spring action. The flap is now closed and locked again. Should the drive cam not be exactly opposite the drive recess 51, the cam will snap resiliently into the recess and then drive the cutter 35 upon the first reciprocating movement of the drive member 49 when the appliance is subsequently put into operation.

What is claimed is:

1. In an electric trimmer including a housing with a longitudinal dimension which is suubstantially greater than its traverse dimension, an electric drive motor mounted in the housing, a trimming cutter set partially within the housing which comprises a stationary cutter and cooperating therewith a drivable cutter which is reciprocatable by the motor, which cutters are each provided with a row of teeth and together are disposed near one end of the housing in such a way that the rows of teeth project out of the housing, and resilient means for resiliently pressing the two cutters against each other, the improvement in combination therewith comprising a flap hingeably connected to said housing and movable between open and closed positions, the flap in closed position covering the part of the trimming cutter set located in the housing, said resilient means situated adjacent said flap and said drivable cutter, said flap in closed position engaging and deflecting said resilient means which thereby resiliently urges said drivable cutter towards said stationary cutter, the improvement further comprising spring-loaded locking means in the housing for releasably locking said flap in said closed position, the distance over which the resilient means is deflected to obtain the resilient loading of the cutters is smaller than the distance over which the flap is moved between its open and closed positions.

2. Apparatus according to claim 1 further comprising a guide slot in one of said cutters parallel to said row of teeth and a cooperating guide projection in the other cutter, the projection extending into the slot and being relatively movable.

3. Apparatus according to claim 1 further comprising a spindle fixedly secured to said housing, said resilient means comprising a helically wound wire spring having a hollow center through which said spindle extends, said spring having two elongated straight ends which engage said flap and drivable cutter respectively when said flap is in its closed position, said two ends when the spring is in relaxed state defining an angle which is smaller than the angle through which said flap can be moved between its closed and open positions.

4. An electric trimmer according to claim 1 further comprising a drive member pivotally and axially movable on said spindle, means for coupling said drive member and drivable cutter comprising a drive cam on one of said components and a corresponding opening in the other component, the cam being insertable in said opening, said resilient means disposed between the flap and the drive member with said elongated ends bearing on the flap and the drive member when said flap is in its closed position.

5. An electric trimmer according to claim 4 wherein said flap and drive member are rotatable relative to each other through an angle $\alpha$, and said flap is hingeable between its open and closed positions through an angle $\beta$ which is greater than said angle $\alpha$, the apparatus further comprising stop means on said flap and said drive member for preventing further mutual rotation.

6. Apparatus according to claim 5 wherein said resilient means between said flap and drive member resiliently urges these components apart when said flap is at its maximum angle of rotation.

7. In an electric trimmer including a housing, an electric motor in said housing and a cutter set including stationary and drivable cutters with cooperating cutting edges, said cutter set having a body portion removably mounted in said housing with said cutting edges projecting outward from the housing, and first coupling means for engaging said electric motor to said drivable cutter for reciprocating same relative to the stationary cutter, the improvement in combination therewith comprising: a flap hingeably connected to said housing and pivotable between a closed position covering said body portion of the cutter set and an open position exposing said body portion, spring means positioned between said flap and said drivable cutter, said spring means having a relaxed state when said flap is in open position, and having a deflected state when the flap is in its closed position engaging and deflecting said spring which engages and urges said drivable cutter against said stationary cutter, and latch means for releasably locking said flap in said closed position, said flap pivoting a distance between its open and closed positions that is greater than the distance the spring means deflects from its relaxed to its deflected state, whereby when the flap is in its open position, the spring means is disengaged from said drivable cutter and said cutter set is easily removable from said housing.

8. Apparatus according to claim 7 wherein said cutting edges of the cutters comprise teeth extending along a first reference line, the apparatus further comprising a slot in a first of said cutters extending parallel to said reference line, and a projection from said housing for engaging and positioning the other cutter and for extending into said slot, whereby said drivable cutter is guided in movement relative to said stationary cutter, parallel to said reference line.

9. Apparatus according to claim 7 further comprising a spindle mounted in said housing, said first coupling means further comprising a drive member pivotally mounted on said spindle and axially movable thereon, said drive member being pivotable between a drive position wherein said first coupling means engages the motor to said drive member and the drive member engages said drivable cutter, and a neutral position wherein said drive member is disengaged from said motor and said drivable cutter.

10. Apparatus according to claim 9 wherein said flap is pivotally mounted on said spindle and said drive member is intermediate the spring means carried by said flap and said drivable cutter, said drive member being urged to pivot to its drive position when said flap is pivoted in its closed position and said spring means presses resiliently on said drive member.

11. Apparatus according to claim 10 wherein said spring means is a helically wound wire spring defining a core through which said spindle extends, said spring having two ends which engage said flap and said drive member respectively.

12. Apparatus according to claim 7 further comprising locking means for engaging and releasably locking said flap in said closed position.

* * * * *

UNITED STATES PATENT AND TRADEMARK OFFICE

CERTIFICATE OF CORRECTION

PATENT NO. : 3,962,785

DATED : June 15, 1976

INVENTOR(S) : HENDRIK POEL

It is certified that error appears in the above-identified patent and that said Letters Patent are hereby corrected as shown below:

Column 1, line 50, "2,241,284" should be --2,241,384--

Column 2, line 55, delete "and that"

Column 4, line 13, after "cams" insert --or guides or projections--

Column 5, line 5, "cooperation" should be --cooperate--

Column 5, line 31, "46A" should be --49A--

Signed and Sealed this

Sixteenth Day of November 1976

[SEAL]

*Attest:*

RUTH C. MASON
*Attesting Officer*

C. MARSHALL DANN
*Commissioner of Patents and Trademarks*